US006155641A

United States Patent [19]

Frost

[11] Patent Number: 6,155,641

[45] Date of Patent: Dec. 5, 2000

[54] VARIABLE HEIGHT CHAIR ADAPTABLE FOR GROWING CHILDREN

[76] Inventor: Beverly J. Frost, 535 Castle Creek Rd., Binghamton, N.Y. 13901

[21] Appl. No.: 09/212,010

[22] Filed: Dec. 15, 1998

Related U.S. Application Data

[60] Provisional application No. 60/069,783, Dec. 16, 1997.

[51] Int. Cl.[7] ..... A47C 1/00; A47C 3/20; A47C 13/00

[52] U.S. Cl. ..... 297/344.12; 297/1; 297/2; 297/3; 297/118; 297/130; 297/440.1; 297/440.13; 297/440.14; 108/11; 108/13

[58] Field of Search ..... 297/344.12, 3, 297/1, 2, 118, 119, 129, 130, 440.1, 440.13, 440.14, 283.1; 108/11, 12, 13; 312/235.4, 237; D6/335, 336, 333, 339, 348

[56] References Cited

U.S. PATENT DOCUMENTS

| | | | |
|---|---|---|---|
| D. 144,404 | 4/1946 | Mabry | 297/3 X |
| D. 147,581 | 9/1947 | Coulter | 297/3 X |
| D. 230,784 | 3/1974 | Lo Turco | 297/250.1 X |
| D. 279,333 | 6/1985 | Brown et al. | D6/335 |
| 2,036,157 | 3/1936 | Mnsberger | 297/3 |
| 2,108,241 | 2/1938 | Wallace | 297/1 X |
| 2,269,834 | 1/1942 | Wagner | 297/2 X |
| 2,440,979 | 5/1948 | Schneider | 297/3 |
| 2,541,612 | 2/1951 | Ricketson | 297/2 |
| 2,622,658 | 12/1952 | Morgan | 297/2 X |
| 2,624,393 | 1/1953 | Andrus | 297/2 X |
| 2,776,700 | 1/1957 | Potter et al. | 297/3 |
| 3,556,586 | 1/1971 | Beardmore | 297/3 |
| 3,592,506 | 7/1971 | Breslow | 297/1 X |
| 3,632,170 | 1/1972 | Witt | 297/440.14 X |
| 3,650,563 | 3/1972 | Hansson et al. | 297/1 X |
| 3,788,700 | 1/1974 | Wartes | 297/440.13 |
| 3,879,083 | 4/1975 | Bumpus | 297/3 |
| 4,181,352 | 1/1980 | Bumpus | 297/3 |
| 4,205,876 | 6/1980 | Cetina | 297/3 X |
| 4,241,949 | 12/1980 | Parker | 297/3 |
| 4,521,052 | 6/1985 | Cone | 297/3 |
| 4,561,692 | 12/1985 | Yestadt et al. | 297/130 X |
| 4,593,950 | 6/1986 | Infanti | 297/3 |
| 4,783,118 | 11/1988 | Ryan et al. | 297/3 |
| 5,160,288 | 11/1992 | Seda | 108/13 X |
| 5,253,933 | 10/1993 | Walker | 297/1 X |
| 5,415,454 | 5/1995 | Fu-Tsung | 297/3 |
| 5,690,379 | 11/1997 | Cayssials | 297/1 X |

FOREIGN PATENT DOCUMENTS

| | | | |
|---|---|---|---|
| 67087 | 12/1982 | European Pat. Off. | 108/11 |
| 2719761 | 11/1978 | Germany | 297/3 |
| 3242148 | 8/1984 | Germany . | |

OTHER PUBLICATIONS

Pheasant, Stephen (1986) Body Space, Anthropometry, Ergonomics and Design, Taylor and Francis Inc., Philadelphia, PA, 76, pp. 90–99.

*Primary Examiner*—Peter M. Cuomo
*Assistant Examiner*—Rodney B. White
*Attorney, Agent, or Firm*—Salzman & Levy

[57] ABSTRACT

A variable height chair provides variable seat height measurements from the floor to the planar surface of the seat. The seat planar surfaces consist of seat panels forming a polygonal core and are supported at each end by two end frame panels. The central axis of the core is offset from the respective centers of the two end frame panels. The end frame panels have a number of identical dimensioned edges placed substantially parallel and apart from each other. The variation in height is achieved by the asymmetrical or offset location of the axis of the polygonal core. Through successive rotation forward or backward, different heights emerge for each planar seat surface. These different heights of the seat planar surfaces provide selectively different heights for persons of varied statures within the same age bracket and in different age brackets.

14 Claims, 12 Drawing Sheets

VARIABLE HEIGHT CHAIR ADAPTABLE FOR GROWING CHILDREN

RELATED APPLICATIONS

This patent application claims the benefit of Provisional Patent Application Ser. No. 60/069,783, filed Dec. 16, 1997.

FIELD OF THE INVENTION

This invention relates to furniture, specifically chairs with variable seat heights.

BACKGROUND OF THE INVENTION

Children in different elementary school systems have a universal problem. Various statured children try to adjust their bodies to standard sized chairs. Children often sit with one leg doubled under their buttocks in order to boost themselves to a higher level. Furniture currently available seems to assume that all first grade children are the same size. Chairs in each classroom are usually the same seat height. Conditions are comparable for second through sixth grades also. There are usually no variations in the chair heights within each classroom. Also, there are no adjustable chairs. This is because most adjustable chairs operate with mechanical or hydraulic mechanisms. Maintenance cost is high for mechanical or hydraulic mechanisms of adjustable chairs. Young and impaired children may find adjustable chairs difficult to operate.

Prior art, adjustable seats have moving parts or generally allow for only two variable seat level choices. For example, Booster Seat, U.S. Pat. No. 4,521,052, issued to Richard E. Cone, is designed with a hinged backrest that also becomes a second seat level when closed. U. S. Design Pat. No. D-230,784, issued to Raymond A. Lo Turco, for Invertible Booster Chair, is designed with two seat levels. Both of these patented designs require placing a booster chair upon an adult chair. This could be dangerous if the seat and the child are not safely strapped to the adult chair. The Convertible Four-way Child's Chair, U.S. Pat. No. 2,440,979, issued to R. G. Schneider, is designed with various height seat levels. It is not made for adult use. One seat level is supported by a rocker base which is not practical in group situations, such as a classroom.

Recognizing the importance for correct seating height, it would be advantageous to provide a versatile, variable height chair. The chair's design should have little or preferably no mechanics. Without any mechanisms, the chair would be safe and easy to use.

The ease in which chairs stack would also be a necessary design feature. A stacking feature benefits classroom versatility, space saving storage and allows for easier housekeeping by janitorial services.

A chair with variable height features would allow a child to select a height level at which to sit which would be comfortable for his or her individual physical stature and would be appropriate for the height of the work area. This would ensure correct posture at the work surface. For example, a child should be able to see his work and reach it with ease, while sitting at a work surface, performing a task, or operating a computer keyboard and viewing the screen.

Children are introduced to computer technology at ever younger ages. The need for correct seating height becomes more apparent with this early introduction. Over time, a precise selection of seat height may help to reduce physical problems that often develop later in adulthood from repetitious motion, such as neck pain, eye strain, wrist tension or back strain. This observation is also considered when assessing the needs for development of a chair with various seat levels.

SUMMARY OF THE INVENTION

The variable height chair of the present invention is a versatile piece of furniture that accommodates children three years of age to adults. Specifically, this chair may benefit children in school classrooms or libraries, where standard-sized chairs often do not meet the needs of every child. This chair is unique in that it can be used comfortably by children of different ages and of varied statures. It is a growth chair, meaning that children can continue to use the chair as they get older and their body sizes change. As a child grows, he/she will not outgrow the chair. Anthropometric data reported by Pheasant, Stephen (1986) Body Space, Anthropometry, Ergonomics and Design, Taylor and Francis Inc., Philadelphia, Pa., 76, pp. 90–99, provides mean seat height and depth for persons of specific ages. The different height levels of the variable height chair can correspond to mean anthropometric measurements, using popliteal height (i.e., vertical distance from the floor to the popliteal angle at the underside of the knee where the tendon of the biceps femoris muscle inserts into the lower leg) and popliteal depth (i.e., horizontal distance from the back of the uncompressed buttocks to the popliteal angle, at the back of the knee, where the back of the lower legs meet the underside of the thigh) for persons of different ages.

There are no mechanics; it is easy to use. The chair is color coded at each seat level, thereby making it easy for a person to visually select his/her seat level. For persons who are sight impaired, handhold openings are placed near the top and towards the front of each end frame. This helps to designate seat levels. Each handhold becomes progressively longer and relates to progressively higher seat levels. The variable height chair is easy to lift. The handholds can be used to carry the chair from place to place. Either the handholds or the backrest/popliteal bar can be used easily to rotate the chair to a different seating height.

Another advantage of the present invention is the ease with which the chair can be stacked. Four chairs may be stacked safely on top of each other. This allows flexibility for maintenance and janitorial service. In a classroom situation, the chair stacking feature frees space for a variety of activities, allowing for more versatility in a room.

The chair can be turned on end to use as a playing surface. When turned on end, the chair can also be used by an adult. For example, a teacher could use the chair when helping a child at the child's desk.

The inventive variable height chair is safe and stable. The end frames prevent younger children from falling out of the chair. The end frames serve as a sled base, lending stability to the chair. Children using the variable height chair would find it difficult to lean back and teeter in the chair, as they may do in a more traditional chair with four legs.

The chair is for persons of various statures, one that provides different seat height distances from the floor to the planar surface of the seat. The various seat planar surfaces are a function of a polygonal core having a central axis supported by two end frame panels. The central axis of the polygonal core is offset from the respective centers of the two end frame panels. The end frame panels have a plurality of identical dimensioned edges placed substantially parallel and apart from each other. The variation in height is achieved by the asymmetrical or offset location of the polygonal core axis. Through successive rotation clockwise or counter-clockwise, different heights are achieved for each planar seat surface. The seat therefore provides selectively different heights for persons of varied statures within the same age bracket and in different age brackets.

The chair is particularly useful in daycare centers, elementary schools, libraries and school cafeteria where children the same ages and older utilize the same room.

Colors can be fun for children to use. The popliteal backrest bars can be color coded with bright colors, each bar being a different color which can help to serve as a quick reference to the height at which the child wants to sit. Anthropometric data can be used to determine the seat depth and seat height of the chair. However, unlike most standard classroom chairs, the variable height chair offers a variety of heights for a child to use. This may be beneficial for a child when performing certain tasks that require different seating levels or when working at a desk that requires a higher chair. Classroom desks are often different heights. Using a variable height chair can solve this problem also. The variations in seating height may suit the task at which they are working and playing. One extra seating height may be obtained by turning the chair onto one end frame, exposing the opposite end panel for a seat. Teachers who work with children may find this seat height level advantageous. They can pull up any variable height chair beside a child who needs their assistance and find there is a seat level that suits their needs. This exposed end panel may also be used as a playing and writing surface.

BRIEF DESCRIPTIONS OF DRAWINGS

A complete understanding of the present invention may be obtained by reference to the accompanying drawings, when considered in conjunction with the subsequent detailed description, in which.

Figure 23:
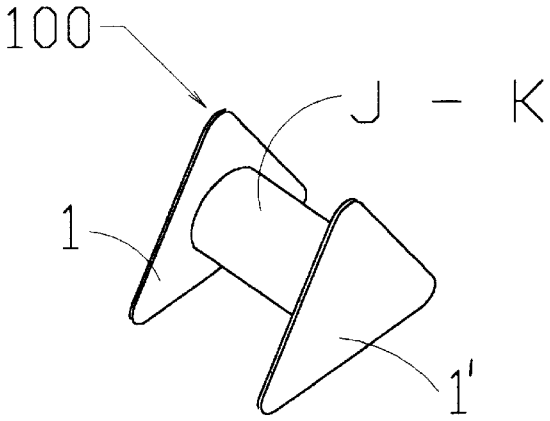
Figure 24:
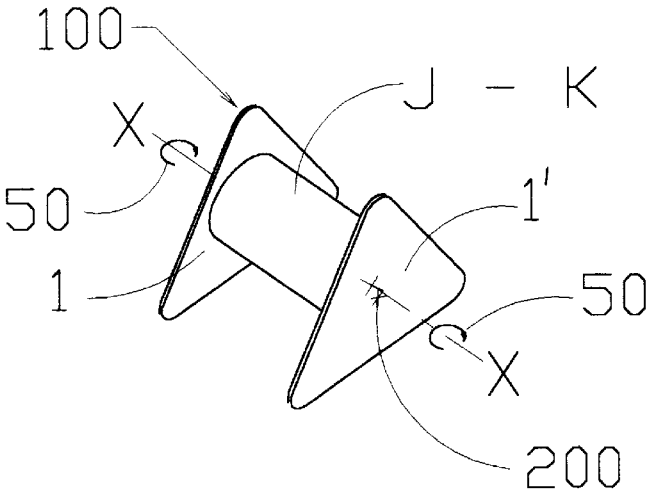

FIG. 23 is a perspective drawing showing a three sided polygonal (triangular) chair depicting a cylinder seat rotated clockwise 120 degrees from its lowest seat height level to its next height seat level; and FIG. 24 is a perspective drawing showing a three sided polygonal (triangular) chair depicting a cylinder seat rotated clockwise 240 degrees from its lowest seat height level to its highest seat level.

DETAILED DESCRIPTION OF PREFERRED EMBODIMENT

Figure 1:
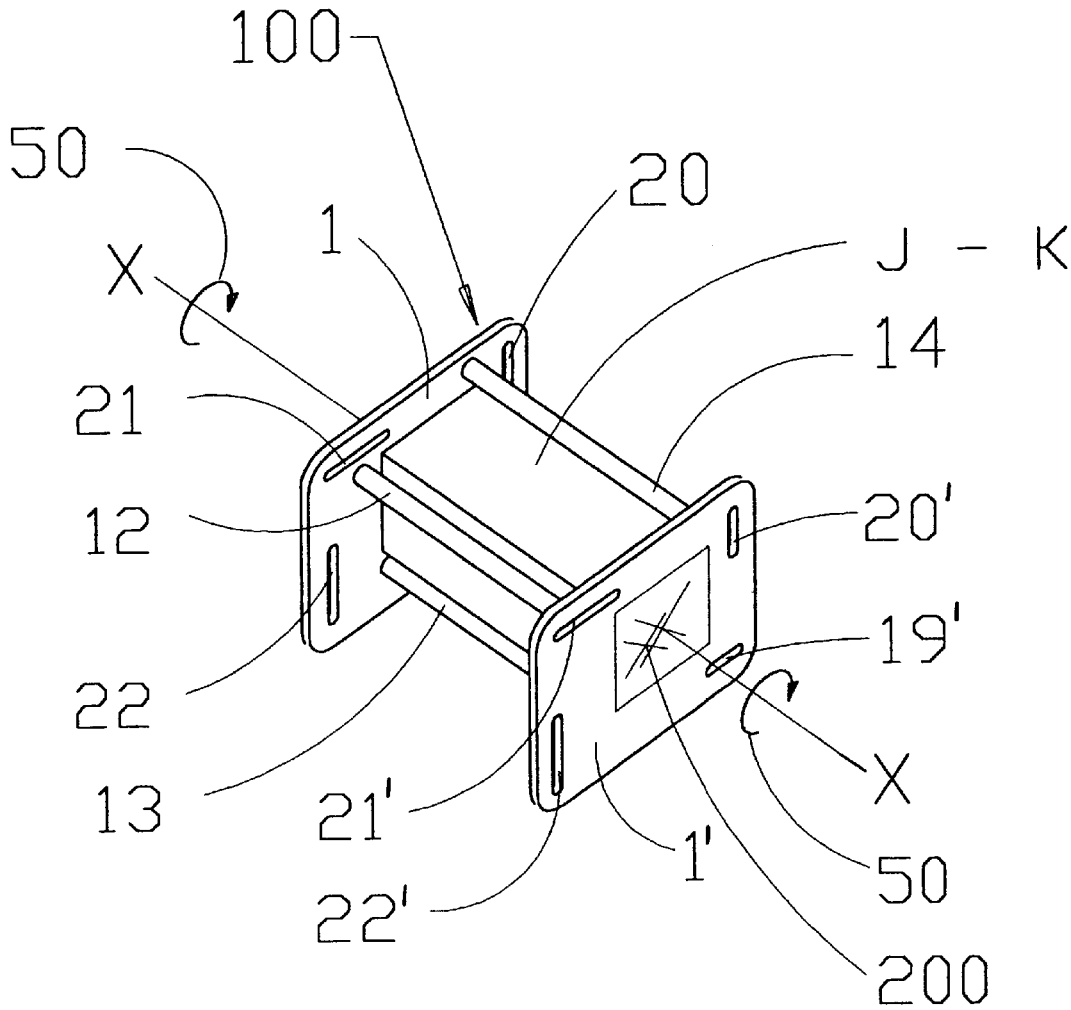
FIG. 1 is a perspective drawing of the variable height chair of the present invention.
Figure 2:
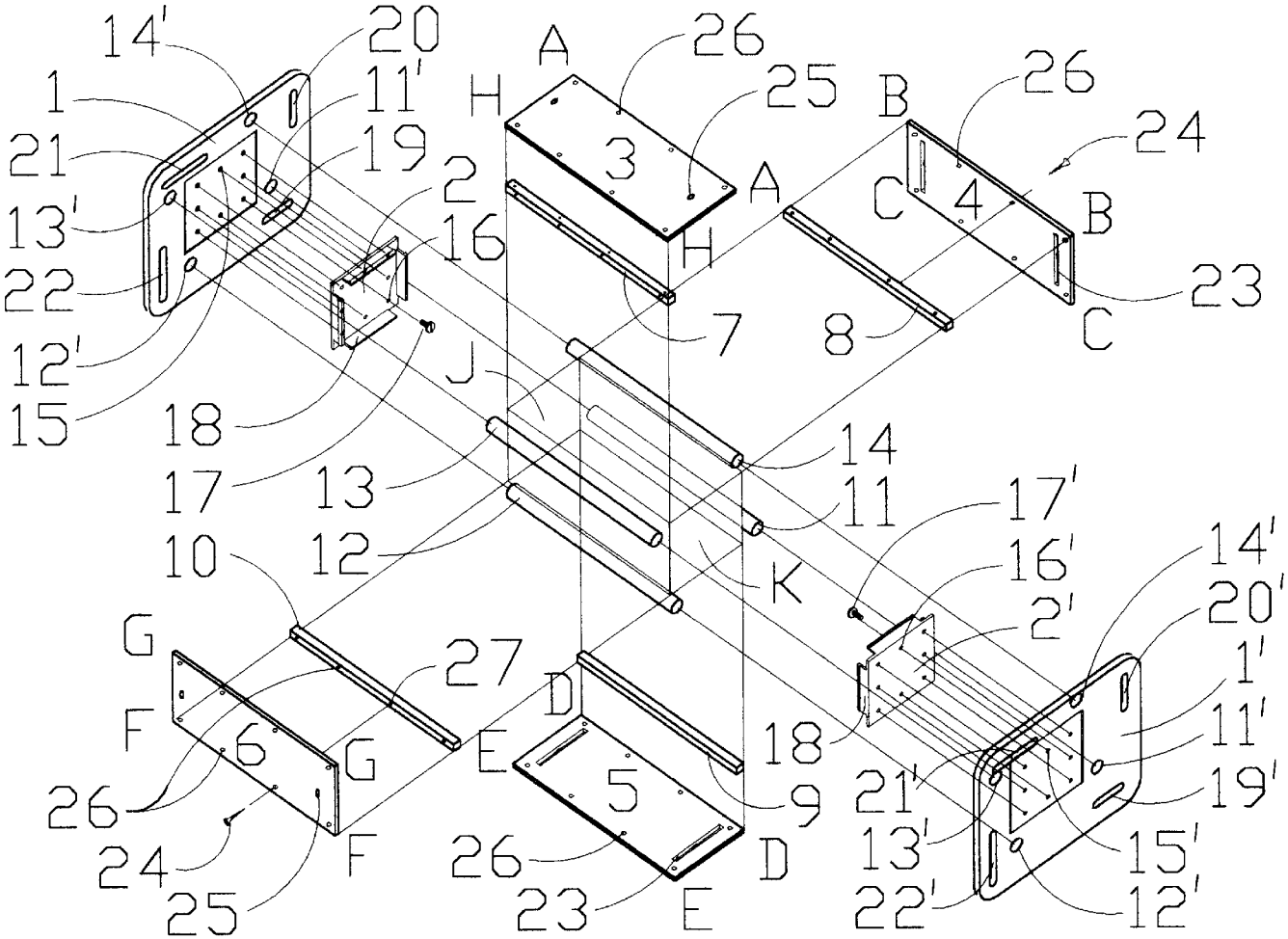
FIG. 2 is a perspective drawing depicting the principal components pertaining to FIG. 1 of the four-sided polygonal variable height chair.
Figure 3:
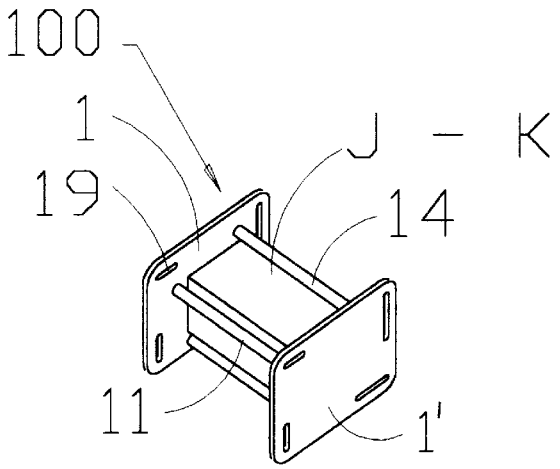
FIG. 3 is a perspective drawing showing the variable height chair at its lowest seat level.
Figure 4:
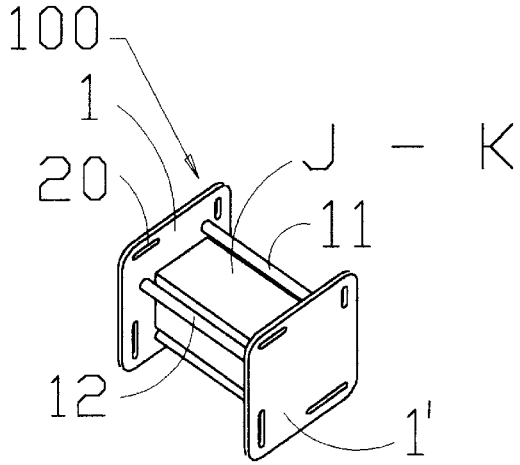
FIG. 4 is a perspective drawing showing the variable height chair rotated 90 degrees clockwise (as viewed from right side) from the lowest seat level to a second seat level.

Referring now to FIGS. 1 and 2, there are shown perspective and exploded views of a (four sided polygonal) variable height chair. The variable height chair 100 consists of two end frames 1 and 1', two connector plates 2 and 2', four seat panels 3, 4, 5 and 6, four corner supports 7, 8, 9 and 10, four multiple purpose popliteal/backrest bars 11, 12, 13 and 14, wood inserts 15 and 15', bolts 17 and 17', and wood screws 24.

Polygonal end frame 1 is designed to correspond to end frame 1'. Outer edges of end frames 1 and 1' are chamfered (beveled). Each corner is rounded to eliminate sharp edges. End frames 1 and 1' each optionally contain beveled handhold cutouts 19, 20, 21, 22 and 19', 20', 21', 22', respectively. Each handhold cutout 19, 20, 21, 22 and 19', 20', 21' 22', respectively, is successively longer relative to each other. The shortest handholds 19 and 19' relate to the lowest level of seat height, while progressively longer handholds 20, 21, 22 and 20', 21' 2', correspond to successively higher seat levels, handhold cutouts 22 and 22' corresponding to the highest of the four seat levels.

End frames 1 and 1' also have recessed holes 11', 12', 13' and 14' which accept corresponding popliteal/backrest bars 11, 12, 13 and 14, respectively. End frames 1 and 1' contain eight wood inserts 15 and 15' which accept bolts 17 and 17'.

Connector bracket 2 attaches to end frame 1. Connector bracket 2' attaches to end frame 1'. Each connector bracket 2 and 2' has drilled holes 16 and 16' that correspond to wood inserts 15 and 15' in end frames 1 and 1'. Connector brackets 2 and 2' are designed with flexible flanges 18.

Each seat panel 3, 4, 5 and 6 contains two slots 23, one near each end to accommodate fastening connector bracket flange 18. In the center of each slot 23 is a release hole 25. The release hole 25 is meant to be used only during assembly if the seat box J-K and popliteal backrest bars 11, 12, 13 and 14 do not line up in their prospective positions before glue dries. A screw driver (not shown) is inserted into each release hole 25 in seat box side J or side K. Each seat panel 3, 4, 5 and 6 is pre-drilled to form holes 26 in support brackets 7, 8, 9 and 10.

Seat box J-K assembles with wood glue (not shown) and wood screws 24. Seat box J-K consists of four seat panels 3, 4, 5 and 6 and four corner supports 7, 8, 9 and 10. Seat panel 3 assembles to corner support 7; seat panel 4 assembles to corner support 8; seat panel 5 assembles to corner support 9; and seat panel 6 assembles to corner support 10.

Seat panel 3, side A—A, attaches to seat panel 4 with attached corner support 8, side B—B. Similarly, seat panel 4, side C—C, attaches to seat panel 5 with attached corner support 9 attached to side D—D, seat panel 5, side E—E, attaches to seat panel 6 with attached corner support 10, attached to side F—F, seat panel 6, side G—G, attaches to seat panel 3 with attached corner support 7 attached to side H—H. The assembled rectangular seat box J-K has open ends, not shown. The seat may be upholstered.

Connector bracket 2 is attached to end frame 1 by means of wood inserts 15 and bolts 17 slipped through connector bracket holes 16 and screwed into corresponding locations, as shown. Connector bracket 2' is attached to end frame 1' by means of wood inserts 15' and bolts 17' slipped through connector bracket holes 16' and screwed into corresponding locations.

The assembled rectangular seat box, side J, is placed over connector bracket 2, which is attached to end frame 1. A rubber mallet (not shown) is used to gently tap and ease end frame 1 onto seat box until the connector bracket flange 18 snaps into the connector slot 23. One end of the popliteal/backrest bars 11, 12, 13 and 14 is placed into recessed holes 11', 12', 13' and 14' in end frame 1. The unattached ends of the popliteal/backrest bars 11, 12, 13 and 14 are inserted into recessed holes marked 11', 12', 13' and 14' in end frame 1'.

The assembled seat box, side K, is positioned on end frame 1' over the connector flange 18. All parts must be in line for their positions. For example, the popliteal/backrest bars 11, 12, 13 and 14 must be aligned with recessed holes 11', 12', 13' and 14' and end panel 2'. The seat box side K must be lined up to accept connector flange 18 on connector bracket 2'. A rubber mallet is used to gently tap and ease together end frame 1' to seat box K and popliteal/backrest bars 11, 12, 13 and 14 until the connector flanges 18 on connector bracket 2 snap into connector slots 23.

Figure 5:
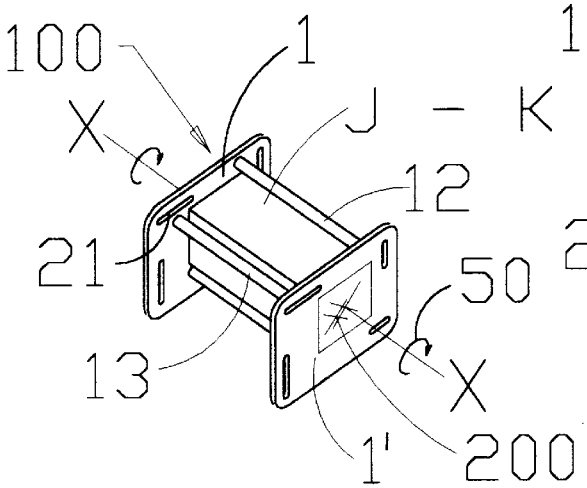
FIG. 5 is a perspective drawing showing the variable height chair rotated 180 degrees clockwise from the lowest seat level to a third seat level.
Figure 6:
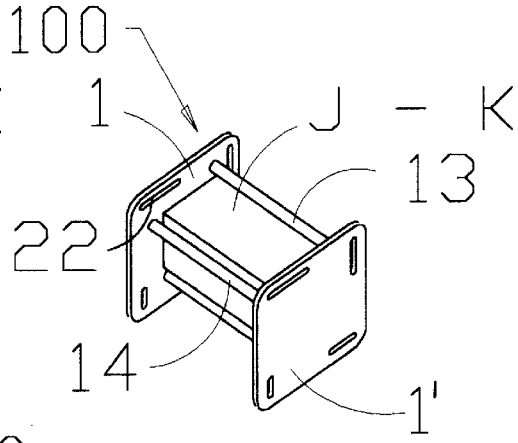
FIG. 6 is a perspective drawing showing the variable height chair rotated 270 degrees clockwise from the lowest seat level to a fourth, highest seat level.

The seat heights are shown progressively higher in perspective views, FIGS. 3–6, which depict successive 90 degree clockwise rotations (arrow 50) about the X axis, as shown in FIGS. 1 and 5. The rotations are clockwise as viewed from the right side of chair 100, for purposes of this description.

The variable height chair 100 can be made from a mold process as is well known in the art. The molds, not shown, are made from tooling sheet steel, cast aluminum or machined steel. Plastic or resin is inserted by different processes into the molds.

The primary use of the variable height chair 100 is to provide four different seat heights. The variable height chair 100 can be scaled to fit persons from three years of age through adulthood. For example, the chair seat levels may vary anywhere from 1 to 3 inches between each 90 degree rotation of a four sided polygonal end frame 1 and 1'. Thus, if the increments were 1" and there are four polygonal sides, the lowest seat level starts at 11" and the highest seat level would be 14". If the increments were 3" and the lowest seat level starts at 11", the highest seat would be 20".

Two methods can be used to rotate the chair between the four levels shown in FIGS. 3–6. The chair may be rotated by using the popliteal/backrest bar 11, 12, 13 and 14. With each clockwise rotation, the backrest bars interchange their purpose and become the next seat levels' popliteal bar. Therefore, it is referred to as the popliteal/backrest bar. Different color popliteal/backrest bars visually differentiate the varied heights.

A person standing in front of the chair can grip the popliteal bar and lift the chair upward. The next succeeding seat level rotates clockwise with ease. The seat box J-K has a central seat core axis X. Each end frame panel 1 and 1' has a center point position 200 (FIG. 1). The seat core axis X is positioned and attached offset from center point position 200 of end frames 1 and 1'. The asymmetrical location of the seat core axis X counterbalances the chair's weight and assists the clockwise rotation of the chair 100. Thus, the counterbalance makes it easier to rotate to the next succeeding seat level. Using handholds 19, 20, 21, 22 and 19', 20', 21', 22' is another method for rotating the chair 100.

Children tend to gravitate toward gripping the end panels 1 and 1' instead of the popliteal bar 11, 12, 13 and 14. This observation has led to the design of handhold cutouts which vary in lengths, corresponding with the height of the variable seat levels. For example, the shortest handhold 19, 19' correlates with the lowest seat level, FIG. 3, and the longest handhold 22, 22' correlates with the highest seat level, FIG. 6. Visually-impaired persons may find the handhold cutouts helpful in choosing their correct seating height. Handholds aide in turning, pushing, pulling and stacking the chair. All handholds may be sized to one length. The handholds may be eliminated from the chair completely.

A molded chair may be rotated by gripping the rolled edge of the end panels. The method of rotation of the chair works on the same principle as the above assembly except the popliteal/backrest bars are conformed into a shape of one smooth body contour. The counter balance principle for each rotation applies to this chair as well. Hand holds are not depicted, but they may also be molded into the chair design. The outer edges of the end panels are flat. This enables the chair to be used as an extra seat height or as a play surface or work area.

Figure 7:
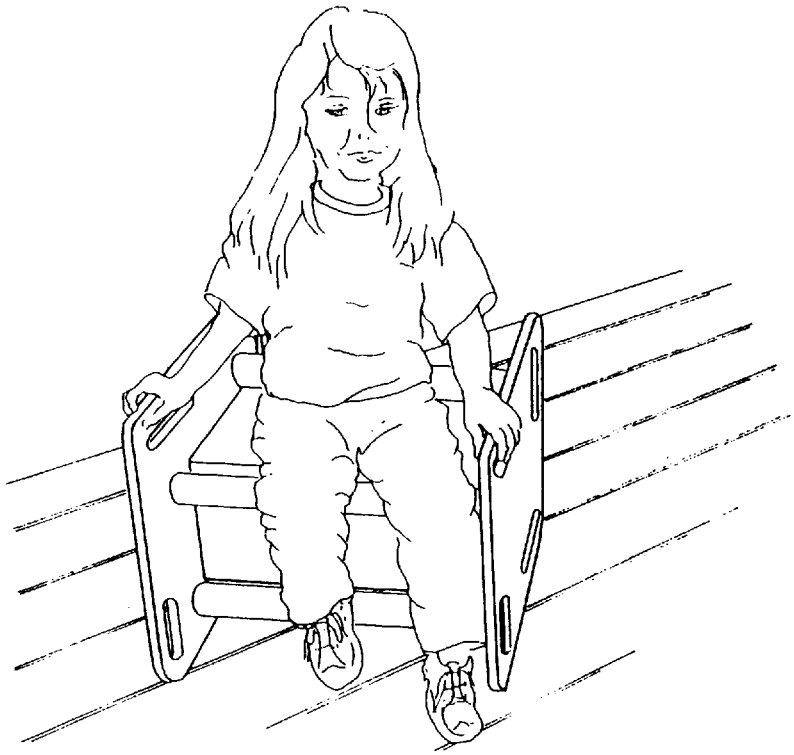
FIG. 7 is a front perspective view of the variable height chair at its lowest seat level and a child of approximately three years of age.

FIG. 7 is a perspective view showing Michelle Denise Lyon, three years old, sitting on a seat, the height of which fits her body structure. Michelle is three feet six inches tall.

Figure 8:
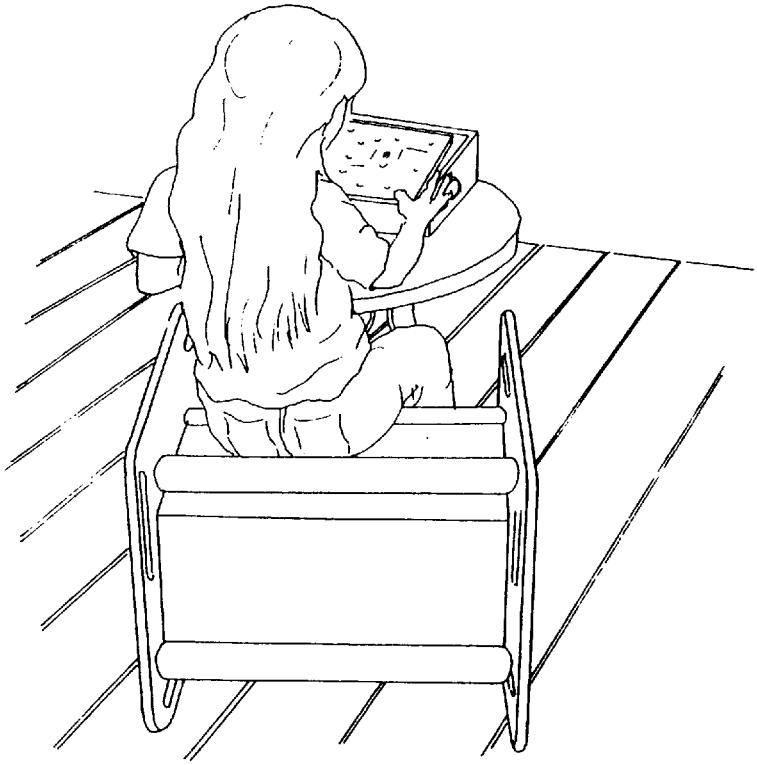
FIG. 8 is a back perspective view of the variable height chair at its lowest seat level and a child thereon.

FIG. 8 is a perspective view of Michelle in concentrated play and well adjusted with her seat choice. She has chosen the lowest level of seating from chair 100.

Figure 9:
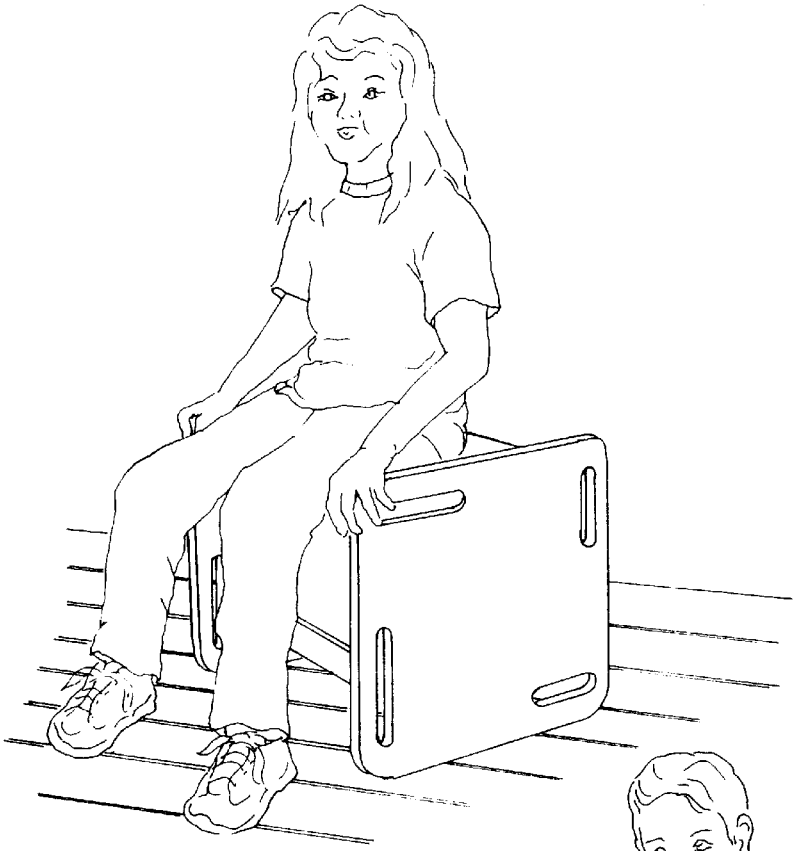
FIG. 9 is a side perspective view of the variable height chair at its third seat level and a child of approximately seven years of age.

FIG. 9 is a perspective view showing Jessie Marie Arnold, seven years old. She has chosen a third level of height to sit upon. Jessie is nineteen inches taller than Michelle (FIG. 7). She is able to use the same chair 100, but has rotated it to the third seat level.

Figure 10:
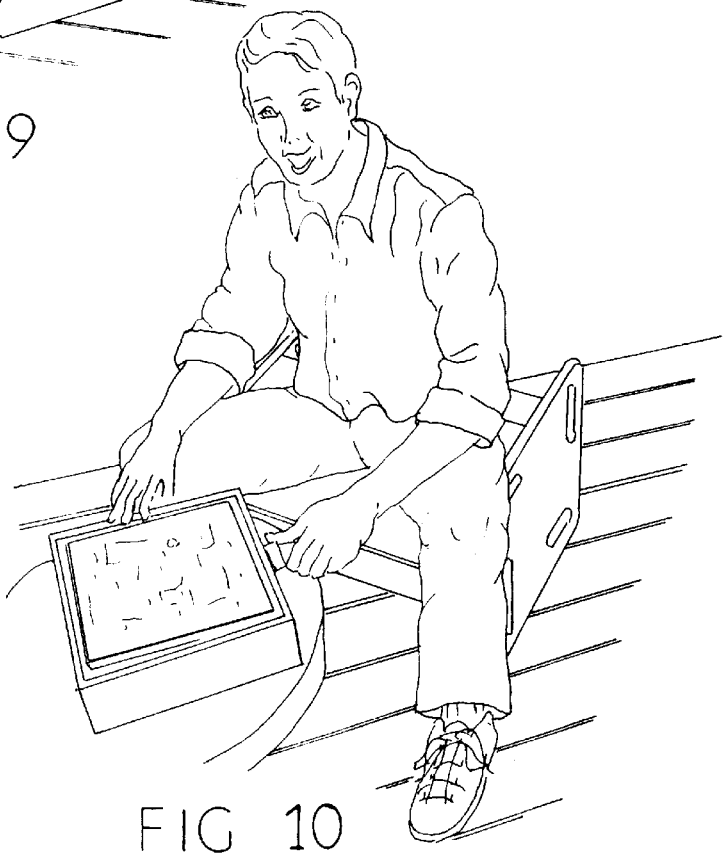
FIG. 10 is a perspective view of the variable height chair and its third level of rotation and an adult instructor.

FIG. 10 is a view of Corey Chad Michael Bryant, a third year college student who is instructing Michelle in how to play a game. Corey is nearly six feet tall. He and Jessie chose to sit upon the third seat height level. There is one higher seat elevation with the next clockwise rotation of the chair 100.

Figure 11:
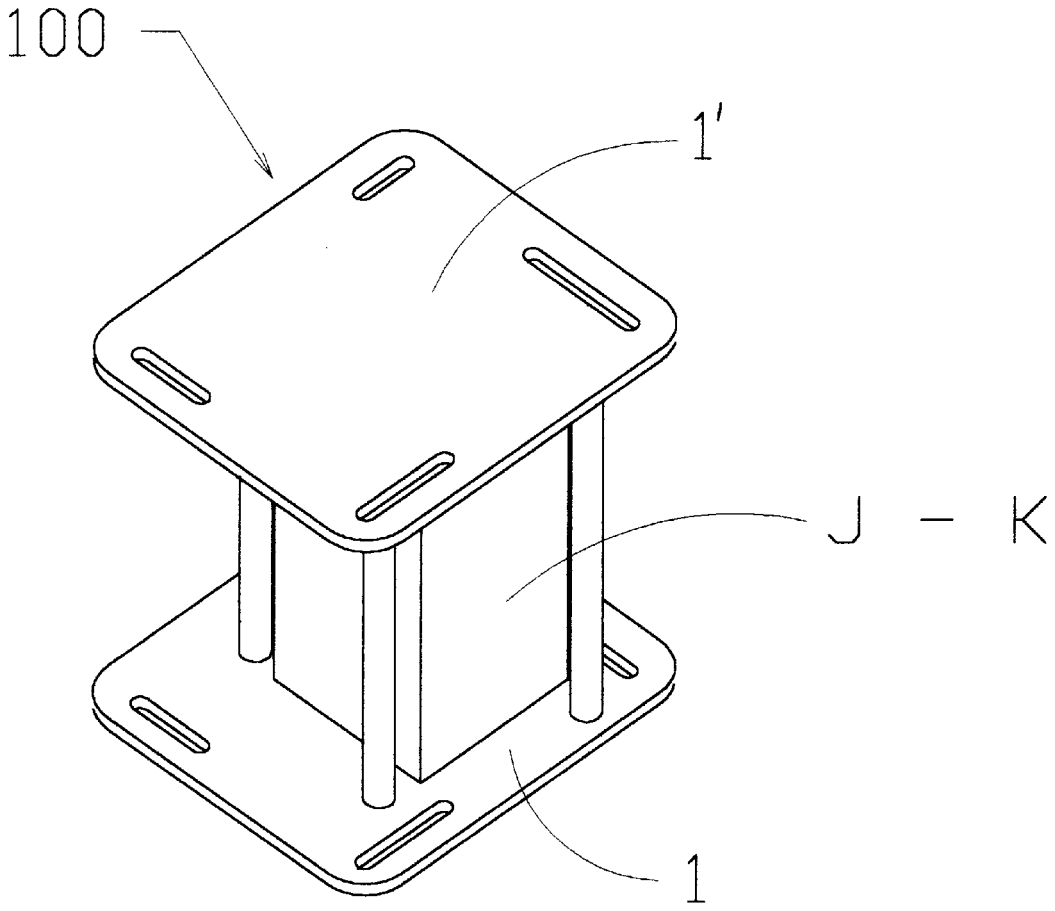
FIG. 11 is a perspective drawing of the variable height chair invention turned on its end frame, resting it on a solid surface.

FIG. 11 is a perspective view of chair 100 turned onto end frame 1, enabling end frame 1' to become a writing surface, work area or an additional seat height. The end frame 1' is designed to be at a level that is higher than the highest seat rotation.

Figure 12:
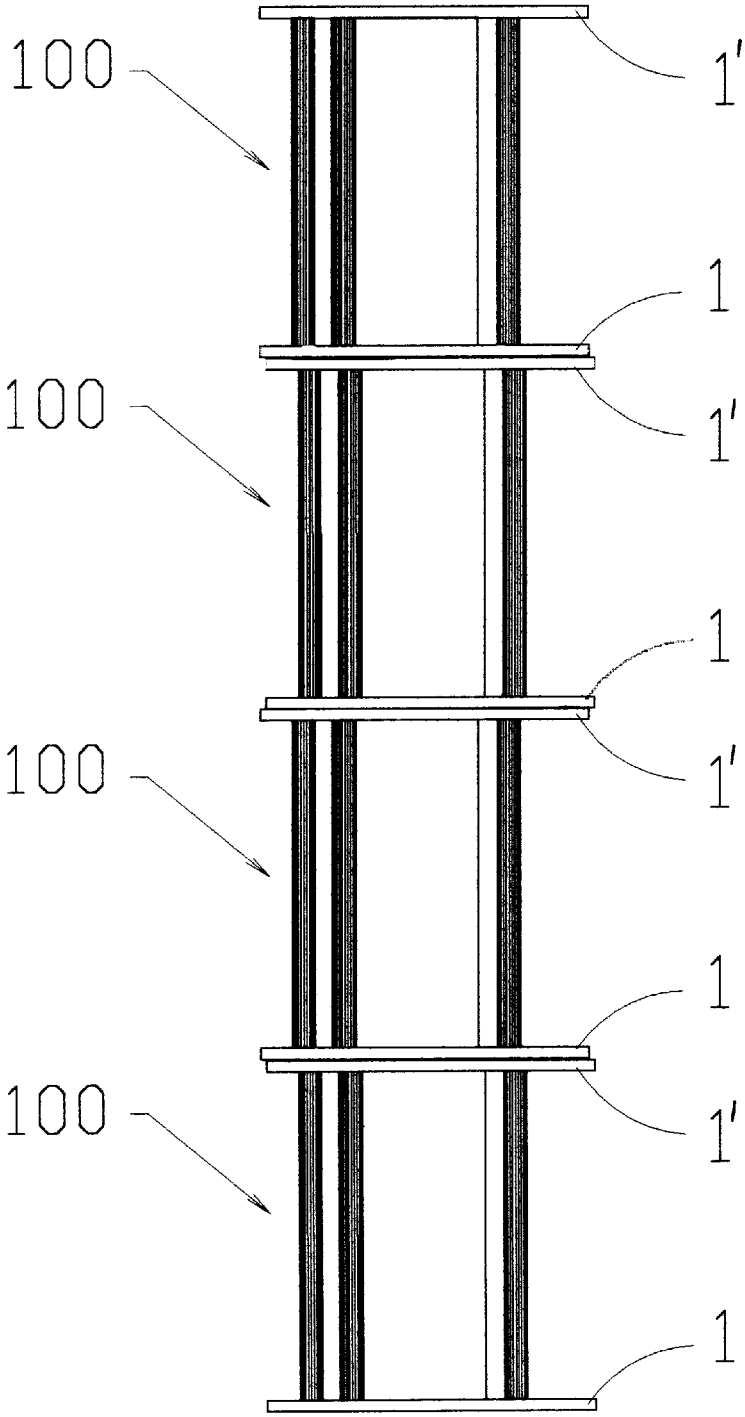
FIG. 12 is an elevation showing four chairs stacked on their end frames.

FIG. 12 is an elevation depicting chairs 100 stacked four high. Stacking assists housekeeping services, opens up floor space for other activities and stores easily.

Figure 17:
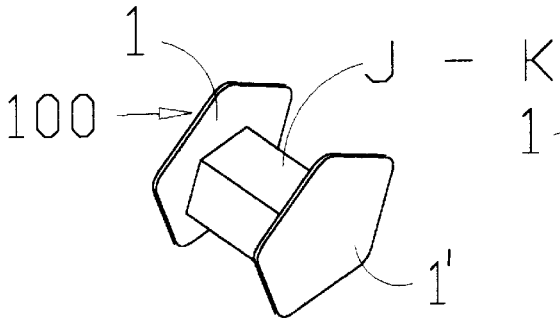
FIG. 17 is a perspective drawing showing a five sided polygonal (pentagon) chair depicting its lowest variable seat height level.

FIG. 17 is a perspective drawing of a pentagon configuration of chair 100. The variable height chair 100 is shown at its lowest seat level.

Figure 18:
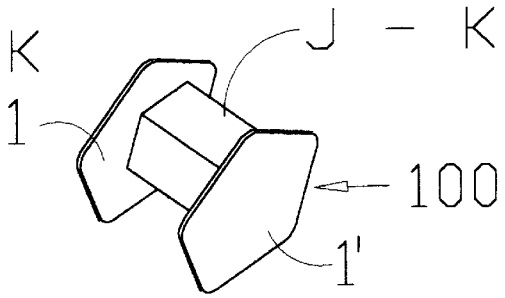
FIG. 18 is a perspective drawing showing a five sided polygonal (pentagon) chair rotated clockwise 72 degrees from its lowest seat height level to its next height seat level.

FIG. 18 is a perspective drawing of the pentagon configuration of chair 100, shown at its second seat level.

Figure 19:
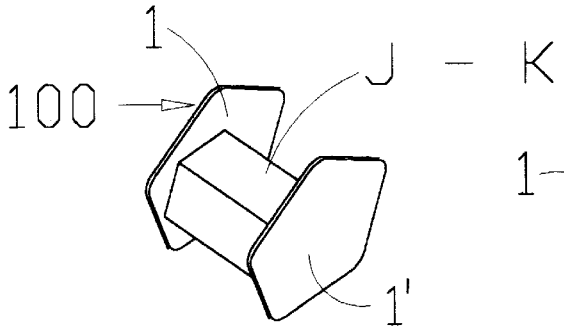
FIG. 19 is a perspective drawing showing a five sided polygonal pentagon) chair rotated clockwise 144 degrees from its lowest seat height level to its third height seat level.

FIG. 19 is a perspective drawing of the pentagon configuration of chair 100, shown at its third seat level.

Figure 20:
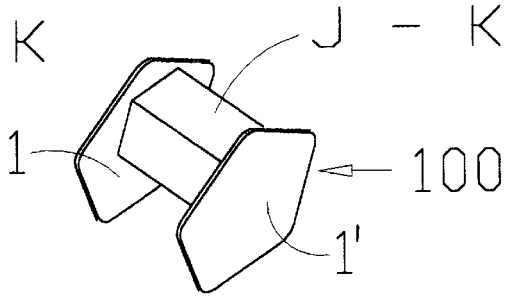
FIG. 20 is a perspective drawing showing a five sided polygonal (pentagon) chair rotated clockwise 216 degrees from its lowest seat height level to the fourth height seat level.

FIG. 20 is a perspective drawing of the pentagon configuration of chair 100, shown at its fourth seat level.

Figure 21:
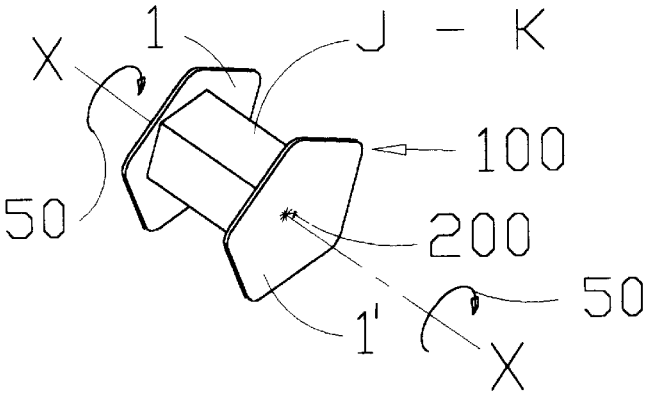
FIG. 21 is a perspective drawing showing a five sided polygonal (pentagon) chair rotated clockwise 288 degrees from its lowest seat height level to its highest seat level.

FIG. 21 is a perspective drawing of the pentagon configuration of chair 100, shown at its highest seat level. Although this is the highest seat level of the pentagon configuration, the difference in height is minimal from FIG. 20. The seat core J-K with axis X is offset from the center 200 of the triangular end panels 1 and 1'. This asymmetrical or offset position creates different seat height levels with each rotation (arrow 50) of end panels 1 and 1'.

Figure 22:
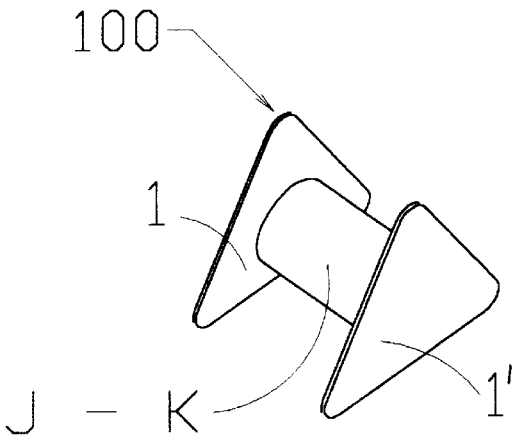
FIG. 22 is a perspective drawing showing a three sided polygonal (triangular) chair depicting a cylinder seat at its lowest variable seat height level.

FIG. 22 is a perspective drawing of a triangle configuration of chair 100, shown at its lowest seat level.

FIG. 23 is a perspective drawing of the triangle configuration of chair 100, shown at its second seat level.

FIG. 24 is a perspective drawing of the triangle configuration of chair 100, shown at its highest seat level. The seat core J-K with axis X is offset from the center 200 of the triangular end panels 1 and 1'. This asymmetrical or offset position creates the different seat height levels with each rotation (arrow 50) of the end panels 1 and 1'.

Increasing or decreasing end frame 1 and 1' panel size will increase or decrease the differential height between the seat levels. The pentagon has varied seat levels, but the following are negative factors:

a) the base of the pentagon is smaller and less stable on the floor;

b) the base for the fourth and fifth seat levels becomes unbalanced and tends to rock forward if sitting near the front edge;

c) in order for the seat planar surface to be large enough for a comfortable seat depth, the end frames must be quite large;

d) two seat levels become so closely related in height that their differences are minimal;

e) the seat planar surface of the next higher seat level protrudes hitting the calf of the leg; and f) triangular end frames 1, 1' of the polygon chair base protrudes, thus becoming a potential tripping hazard. Whether the seat J-K of the chair 100 is configured with three flat planar surfaces or a cylinder for a seat, the base can be a hazard.

The seat planar surface configurations may conform to the end frame configurations or other geometric forms, such as a cylinder. The cylinder form J-K (FIGS. 22, 23 and 24) has no back rest, so it can be approached from either the back or front of the chair 100. The disadvantage of this design, however, is that a child could sit back too far and fall backwards.

Experimentation with these polygonal configurations leads to the conclusion that the optimal and most practical shapes of the end panels are the square and rectangle.

Variation in materials are a design choice of the manufacturer. End panels 1 and 1' may be made from wood, laminated hardwood, metal, strong cardboard, plastics or resins (i.e., clear or colored plexiglas or a hollow core plastic).

The seat panels 3, 4, 5 and 6 may be made from wood, laminated hardwood, strong cardboard, masonite, particle board, wafer board, metal, plastics or resins.

Figure 13:
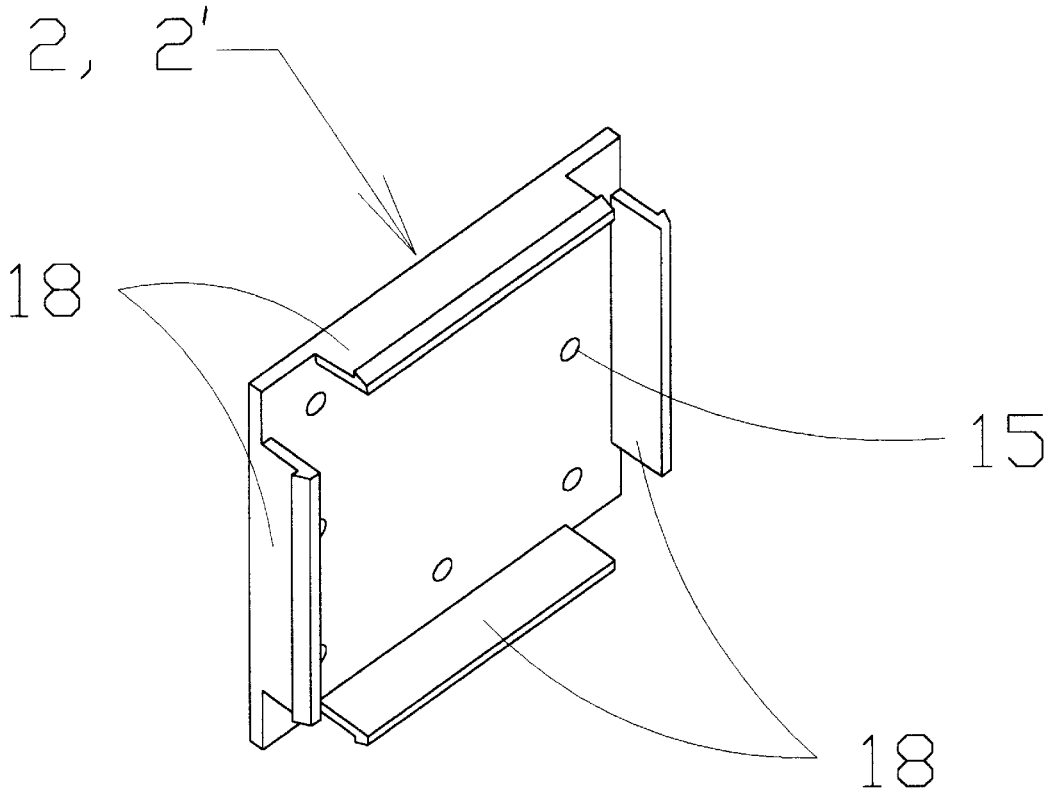
FIG. 13 is a perspective drawing showing an optional connector plate, used to attach the seat box to the end frames.

Referring now to FIG. 13, connector brackets 2 and 2' represents one form of attaching seat box J-K to end frames 1 and 1'.

Figure 14:
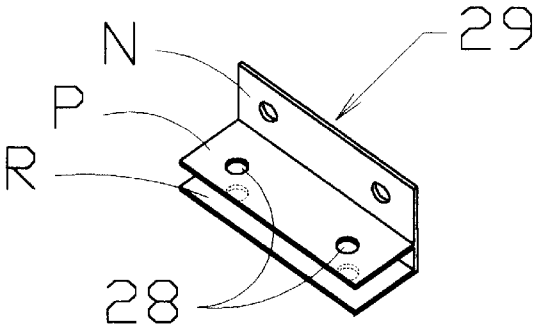
FIG. 14 is a perspective drawing showing an optional clip used to attach the seat box to the end frames.
Figure 15:
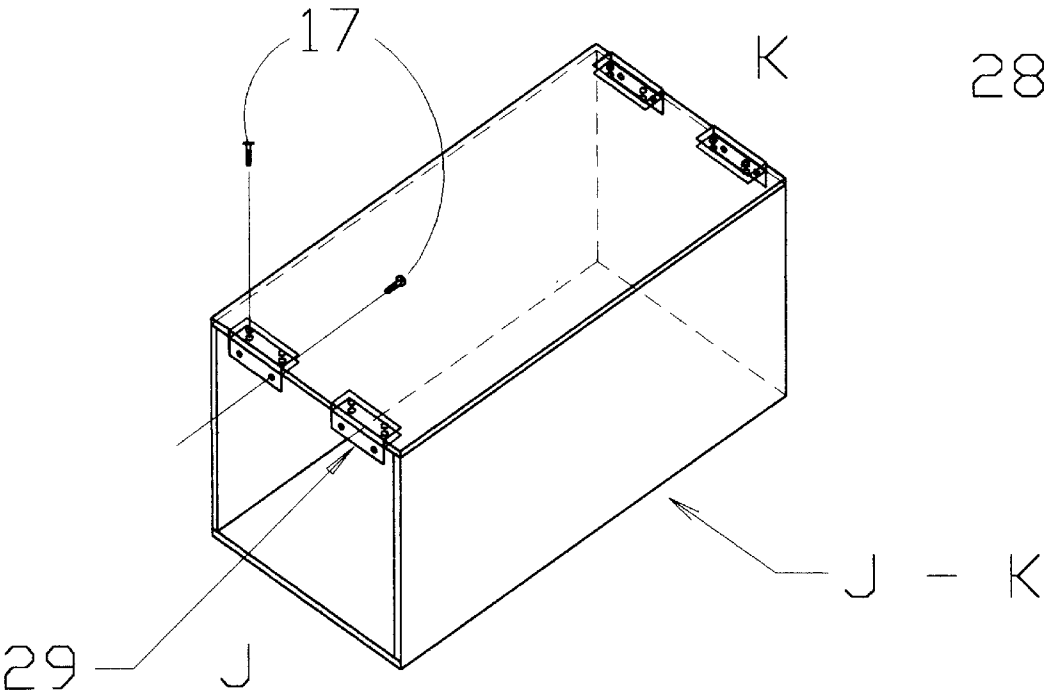
FIG. 15 is a perspective drawing showing the seat box with four optional clips on one of the four seat panels.

Another method may use clips 29 (FIGS. 14 and 15), attached with bolts 17 to the end frames 1 and 1'. Bolts 17 pass through flange N of clip 29 into wood inserts 16 at specified locations asymmetrical to the center of the end frames 1 and 1'. Each end panel 3, 4, 5 and 6 of the seat box assembly J-K slides between flanges P and R of clips 29. The seat box J-K is drilled at the location of holes 28 in each clip 29 and secured by bolts 17. The hole 28 in flange P is threaded to accept bolts 17 from the top of each seat panel 3, 4, 5 and 6. Other methods may be to thread a rod through the seat box J-K or through each popliteal/backrest bar 11, 12, 13 and 14 and secure it with a smooth nut cap, not shown.

Handhold cutouts 19, 20, 21 and 22 may be approached in a different manner. Handholds can be depressions within the exterior and/or interior of end frames 1 and 1'. Handholds may be uniform length or they may be eliminated altogether. Eliminating handhold cutouts will not affect the principal purpose of the chair; it does allow for a larger writing area or work surface when placed on one end frame 1 or 1'.

Popliteal/backrest bars 11, 12, 13 and 14 may be made from solid wood dowels, metal, plastic or resin or cardboard. Solid wood dowels may be contoured, somewhat conforming to a person's buttocks.

Figure 16A:
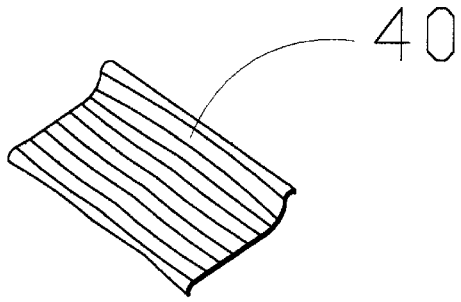
FIGS. 16 and 16A are perspective depictions of the variable height chair, contour shape developed from a mold process which uses resin products, virgin or recycled plastics.
Figure 16:
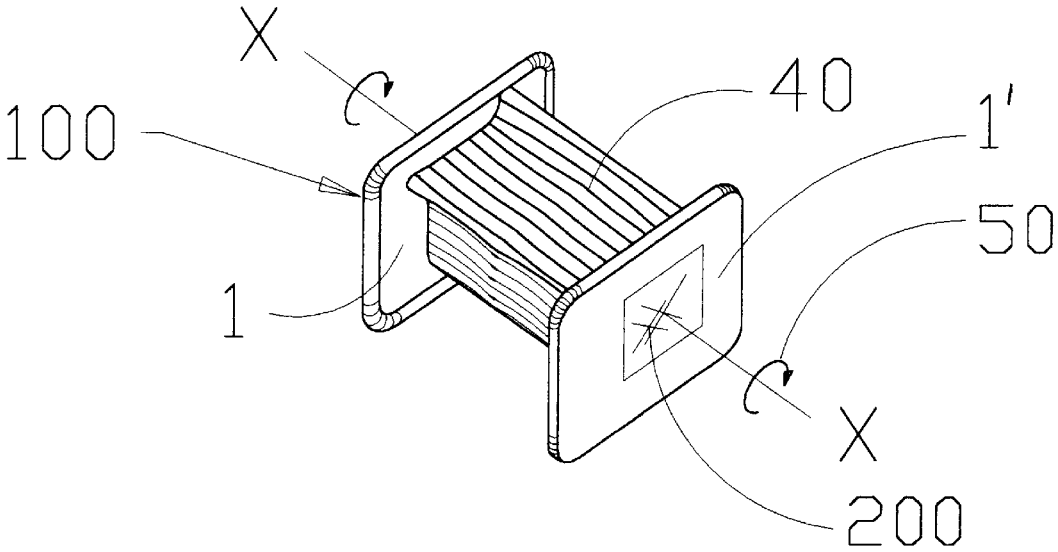

Referring now to FIG. 16, the entire variable height chair may be made from plastics or resins by universally known mold processes, blow mold or rotation mold. The variable height chair 100 may be made from recyclable plastic products. Plastic can be colorful, durable, lightweight, and maintenance free. Chair 100 may be made in three molds. Two separate molds made for each end frame 1 and 1', being that they are mirror images of each other. A third mold is required for the seat planar surfaces. Each seat level (FIG. 16A) may be contour molded 40 as one planar surface, incorporating in the mold, the popliteal/backrest and seat planar surface as one. Each seat may be of different color and assembled as a separate part. The resulting design of the polygonal end frame configuration should accept seat molded pieces by means of a press fit (not shown) that will not come apart with use. Making the chair with three molds allows for knockdown shipment of the variable height chair, resulting in less freight charges.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Since the function of the variable height chair is its adaptability to fit persons with varied statures within the same age bracket and different age brackets, which is particularly important in daycare centers, elementary schools, libraries and school cafeterias where children the same ages and older utilize the same room, the primary purpose of the chair is to satisfy serving various statured children with a seat height that suits their stature. Colors can be fun for children to use. The popliteal/backrest bars can be color coded with bright colors, each bar being a different color which can help to serve as a quick reference to the height the child wants to sit upon. Anthropometric data can be used to determine the seat depth and seat height of the chair.

However, unlike most standard classroom chairs, the variable height chair offers a variety of heights for a child to use. This may be beneficial for a child when performing certain tasks that require different seating levels or when working at a desk that requires a higher chair. Classroom desks are often different heights. Using a variable height chair can solve this problem also. The variations in seating height may suit the task upon which they are working. One extra seating height may be obtained by turning the chair onto one end frame, exposing the opposite ends frame for a seat. Teachers who work with children may find this seat height level advantageous. They can pull up any variable height chair beside a child who needs their assistance and find there is a seat level that suits their needs. This exposed end panel may also be used as a playing and writing surface.

Having thus described the invention, what is desired to be protected by Letters Patent is presented in the subsequently appended claims.

What is claimed is:

1. A chair for persons of various heights comprising:

a) two end panels, each having identical dimensions, a plurality of continuous straight edges and a center point, and being disposed substantially parallel to and spaced apart from each other; and b) a polygonal core having a cross-section and a plurality of planar faces disposed between and supported by said two end panels, said cross-section of said polygonal core having dimensions less than said dimensions of said end panels, said polygonal core having a central axis, said central axis being offset from respective center points of said end panels, whereby an outside surface of each of said polygonal core faces is disposed at a predetermined distance from each of most proximate respective edges of said end panels, none of said distances between each of said faces and each of said most proximate respective edges being equal.

2. The chair for persons of various heights in accordance with claim 1, wherein said polygonal core has a substantially rectangular cross section.

3. The chair for persons of various heights in accordance with claim 1, wherein said polygonal core has a substantially square cross section.

4. The chair for persons of various heights in accordance with claim 1, wherein said polygonal core has a five-sided cross section.

5. The chair for persons of various heights in accordance with claim 1, wherein said polygonal core has a substantially triangular cross section.

6. The chair for persons of various heights in accordance with claim 1, wherein said end panels each comprise a substantially polygonal shape.

7. The chair for persons of various heights in accordance with claim 1, wherein said end panels each comprise a substantially rectangular shape.

8. The chair for persons of various heights in accordance with claim 1, further comprising at least one handhold disposed in each of said end panels.

9. An adjustable chair for use on a floor by individuals of different heights, comprising:

a) a pair of regular polygonal end panels having substantially straight edges, each edge being equal in length, and disposed parallel to each other, each of said end panels having a first major plane;

b) at least three planar surfaces forming a polygon, each surface having a respective second major plane perpendicular to the first major plane of each of said end panels; and c) means for attaching said at least two planar surfaces to said pair of end panels to form respective sitting surfaces, said sitting surfaces, when each oriented parallel to the floor, being displaced a respective, predetermined distance therefrom.

10. The adjustable chair in accordance with claim 9, wherein said end panels each comprise a substantially rectangular shape.

11. The adjustable chair in accordance with claim 9, further comprising at least one handhold disposed in each of said end panels.

12. The adjustable chair in accordance with claim 9, wherein each of said respective, predetermined distances from each of said respective sitting surfaces to said floor is different from one another.

13. The adjustable chair in accordance with claim 9, wherein each of said sitting surfaces has an outermost edge, and further comprising a post connected to each of said end panels proximate said sitting surface outermost edge.

14. The adjustable chair in accordance with claim 13, wherein said posts comprise a circular cross section.

* * * * *